US005193603A

United States Patent [19]

Whisnant

[11] Patent Number: 5,193,603

[45] Date of Patent: Mar. 16, 1993

[54] DISPLAY FRAMING APPARATUS

[75] Inventor: Hubert E. Whisnant, Charlotte, N.C.

[73] Assignee: Whisnant Displays, Inc., Charlotte, N.C.

[21] Appl. No.: 806,160

[22] Filed: Dec. 12, 1991

[51] Int. Cl.[5] ..... A47G 5/00

[52] U.S. Cl. ..... 160/135; 160/229.1

[58] Field of Search ..... 160/135, 351, 352, 229.1; 52/239, 238.1, 240; 40/605, 606, 610

[56] References Cited

U.S. PATENT DOCUMENTS

| | | | |
|---|---|---|---|
| 3,154,870 | 11/1964 | Hopp et al. . | |
| 3,428,108 | 2/1969 | Singer | 40/605 X |
| 3,430,997 | 3/1969 | Propst et al. | 52/239 X |
| 3,466,777 | 9/1969 | Wistrand et al. . | |
| 3,811,785 | 5/1974 | Hagglund . | |
| 3,901,612 | 8/1975 | Canin . | |
| 4,021,973 | 5/1977 | Hegg et al. | 160/351 X |
| 4,103,465 | 8/1978 | McDonald, Jr. . | |
| 4,448,231 | 5/1984 | Salkeld et al. | 160/135 |
| 4,545,142 | 10/1985 | Whisnant . | |
| 4,601,145 | 7/1986 | Wilcox | 160/351 X |
| 5,105,594 | 4/1992 | Kirchner | 160/135 X |

OTHER PUBLICATIONS

"Daymond Modular Systems" (7-page brochure).

*Primary Examiner*—David M. Purol

*Attorney, Agent, or Firm*—Shefte, Pinckney & Sawyer

[57] ABSTRACT

The present invention is a display framing apparatus utilizing a unique side frame member positioned on the side of a display panel. The side frame member has a cavity extending its length and opening at its opposite ends and an assembly structure located within the cavity for quick connection and disconnection of the side frame member to the frame of other panels. The assembly structure has a connection member selectively engageable with and disengageable from the frame of another panel, and an extensible member securing the connection member within the cavity for movement of the connection member by elongation of the extensible member between an inoperative position housed within said cavity and an engaged position wherein the connection device may be engaged with the frame of another individual panel.

21 Claims, 4 Drawing Sheets

DISPLAY FRAMING APPARATUS

BACKGROUND OF THE INVENTION

Various forms of modular panelized apparatus for use in constructing temporary displays and like structures are known. Typically, such apparatus includes a number of sheet-like panels and compatible framing members adapted for assembling the panels in various relations to one another to provide the desired structure. This general type of modular apparatus finds greatest application in the construction of temporary booths, exhibits, showcases, partitions and like display structures and fixtures as are used at exhibitions and trade shows as well as in many retail sales establishments. Perhaps the single most important characteristic desirable in such modular structures is the capability for quick, secure and simple assembly and disassembly so as to best facilitate their usual temporary use. While considerable effort has been devoted in the past to the designing of modular apparatus with this capability, conventional apparatus of this type primarily require the utilization of screws or similar means of fixing adjacent panels to one another and therefore still require a relatively considerable amount of time using appropriate hand tools for assembly and disassembly.

One conventional type of modular apparatus is manufactured by Applicant under the trade designation "MOBILITE" and "MOBILITE II." Basically, these apparatus utilize a particular system of framing members fitted about the side edges of each panel in combination with separate coupling members which are inserted into the frame members surrounding the panels and adapted for connecting adjacent panels horizontally along contiguous side edges thereof as well as for connecting panels vertically on top of one another. The coupling members are structured alike except that specific ones are built for use with a specific number of panels. The MOBILITE couplings comprise an elongated threaded bolt extending through a first nylon bushing, then through a first opening in a separator plate and then through a second nylon bushing. The bolt extends sufficiently beyond the second bushing to receive in a threadable fashion a nut which is tightened to hold the pieces of the coupling together. Each separator plate is constructed for the reception of a certain plurality of the above-described bushing assemblies. For example, a separator plate may be adapted for receiving two, three, four or more of the above-described bushing assemblies in a particular layout to facilitate assembly of the panels in a particular arrangement.

While the MOBILITE systems have been fairly successful in the marketplace, they are still known to suffer from the drawback that, because the MOBILITE couplings must be separately stored when the panel display apparatus is disassembled and not in use, the couplings are easily lost or misplaced which can slow down or altogether prevent assembly of the panels.

SUMMARY OF THE INVENTION

In contrast, the present invention provides a significant and substantial improvement in display framing apparatus of the general type of the above-described MOBILITE systems. It is a primary object of the present invention to provide an assembly arrangement in such type of display framing apparatus adapted for quick, secure and simple connection and disconnection of framing members which either does not require the use of tools or requires only limited tool use for assembly and disassembly.

It is another object of the present invention to provide such an improved display framing apparatus the panels of which may be completed in advance of use for later assembly in a particular desired arrangement of display panels and which will facilitate the assembly and disassembly of the arrangement at the point of use usually in a matter of minutes.

Most basically, the display framing apparatus of the present invention utilizes a unique side frame member positioned on the side of a display panel. The side frame member is formed with a cavity at at least one end of the side frame member and an assembly structure is located within the cavity for quick connection and disconnection of the side frame member to the frame of other panels. The assembly structure has a connection member selectively engageable with and disengageable from the frame of another panel, and an extensible member securing the connection member within the cavity for movement of the connection member between an inoperative position housed within the cavity and an engaged position wherein the connection member may be engaged with the frame of another individual panel.

In the preferred embodiment, each panel has a side frame member along opposite vertical sides thereof with the cavity in each side frame member extending the full length and opening at each opposite end of the side frame member. The assembly structure comprises a device for detachably connecting display panels by the use of a hook-shaped connection member secured to a body portion housed in the cavity of the upright longitudinal side frames of each panel by way of an elastic rope, such as bungee-type cord, or by way of a spring extending through the cavity of the side frame members to connect the upper and lower hook members together. In this manner, each hook member can be selectively pulled outwardly from the end of its associated frame member and turned outwardly to engage with the corresponding cavity of an adjacent panel's side frame member or, alternatively, turned inwardly to engage the wall of the cavity if not needed for connection purposes.

Further features and advantages of the present invention will be apparent from the drawings and the following detailed description of the preferred embodiment.

DESCRIPTION OF THE PREFERRED EMBODIMENT

Figure 1:
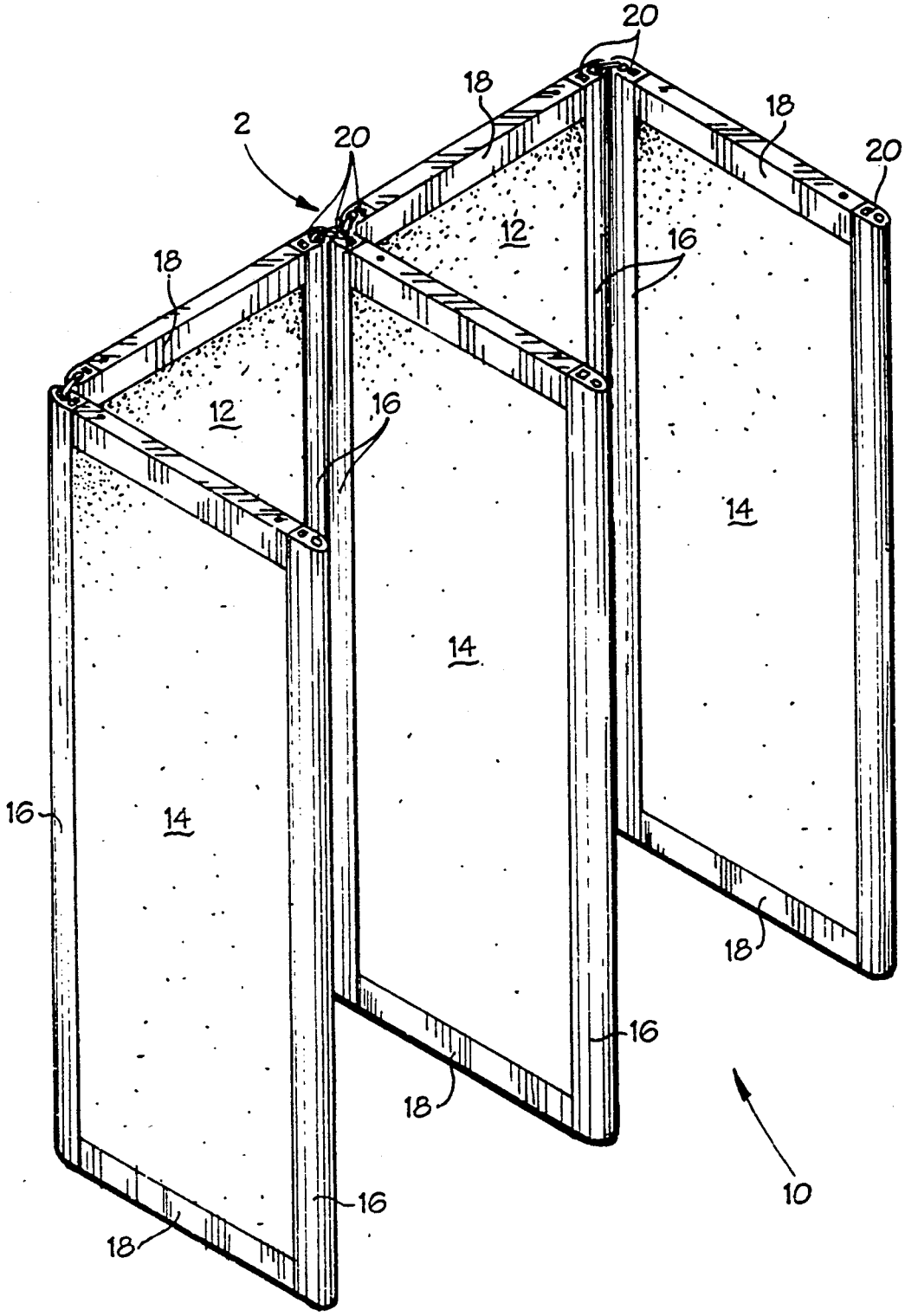
FIG. 1 is a perspective view of a display assembly constructed utilizing the display framing apparatus of the present invention.

Referring now in greater detail to the accompanying drawings, a representative display assembly of the type which ordinarily is employed as an exhibit at an exhibition or trade show is indicated generally at 10 in FIG. 1. Basically, the display assembly 10 includes five display panels 12, 14 bordered and joined together in the illustrated assembly by the display framing apparatus of the present invention. Such display framing apparatus includes side frame members 16 and upper and lower frame members 18 bordering each panel 12, 14 along its side edges. For convenient shorthand reference, an assembly of a panel 12, 14 with its panel frame members 16, 18 will hereinafter be designated as a "panel assembly". Side frame members 16 contain assembly devices 20 for quick, secure and simple assembly and disassembly of the display 10. The assembly devices 20 join the several panel assemblies in side-by-side relation along the side frame members 16.

The panels 12, 14 constitute planar sheets of generally any desired material, of any size and shape. As will be understood, the panel material employed will depend upon the desired end use of the panel assembly. Typically, a lightweight material is preferred to facilitate ease of handling of the panels 12, 14 in assembly and disassembly thereof as well as in transportation and storage thereof. For this purpose, the panels 12, 14 may be constructed of a styrofoam core having a decorative covering such as a fabric or the like adhered or otherwise affixed thereto. Alternatively, the panels 12, 14 may be of glass, plastic or another transparent or translucent material. Preferably, the panels 12, 14 are rectangular or square in shape for greater versatility and interchangeability in their use. For convenience, it is also preferred that the panels 12, 14 be relatively small in size again for purposes of convenience and ease in the handling of the panels.

Figure 2:
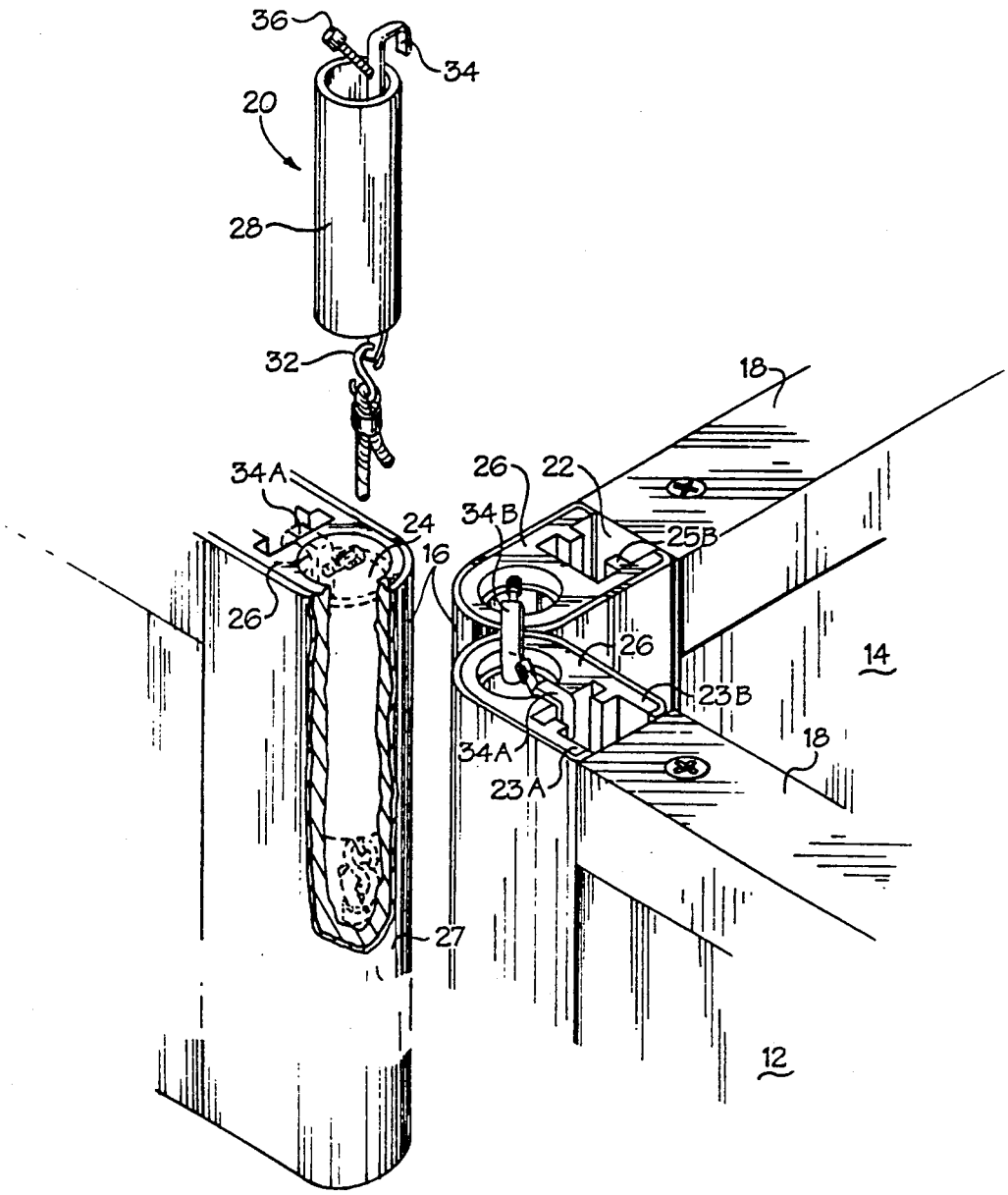
FIG. 2 is an enlarged perspective view of a portion of the display assembly of FIG. 1 as viewed along the arrow 2 therein, illustrating the connection of frame members and their respective panels.
Figure 2:
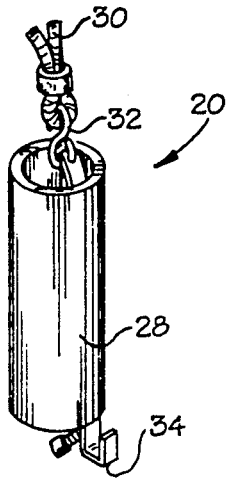
Figure 3:
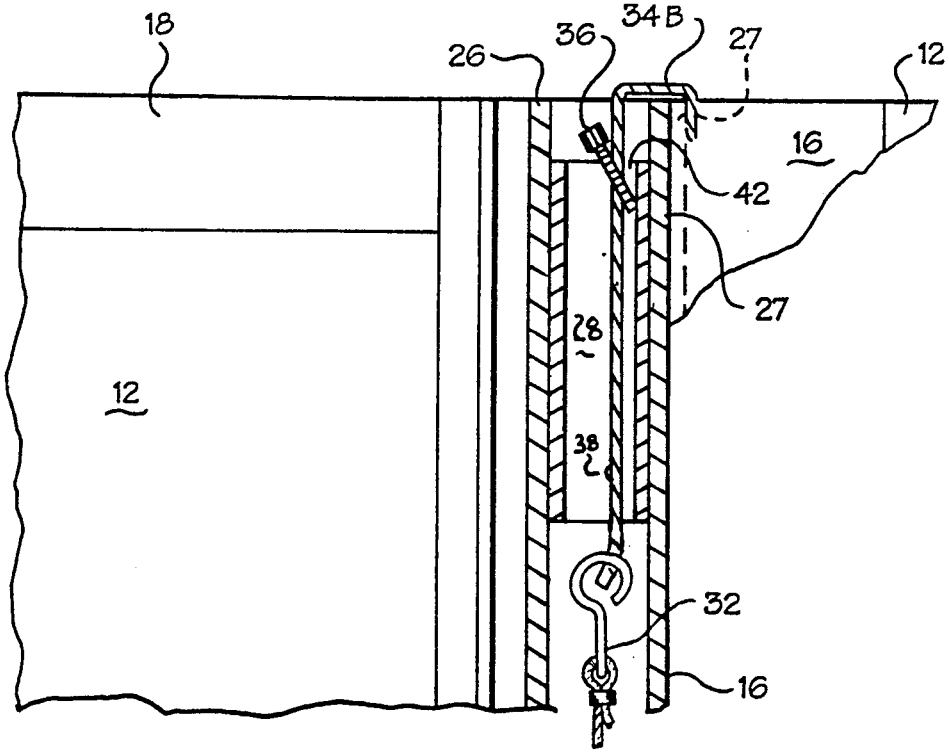
FIG. 3 is a vertical cross-sectional view of an assembled panel of FIG. 2 taken along line 3—3 thereof.
Figure 3:
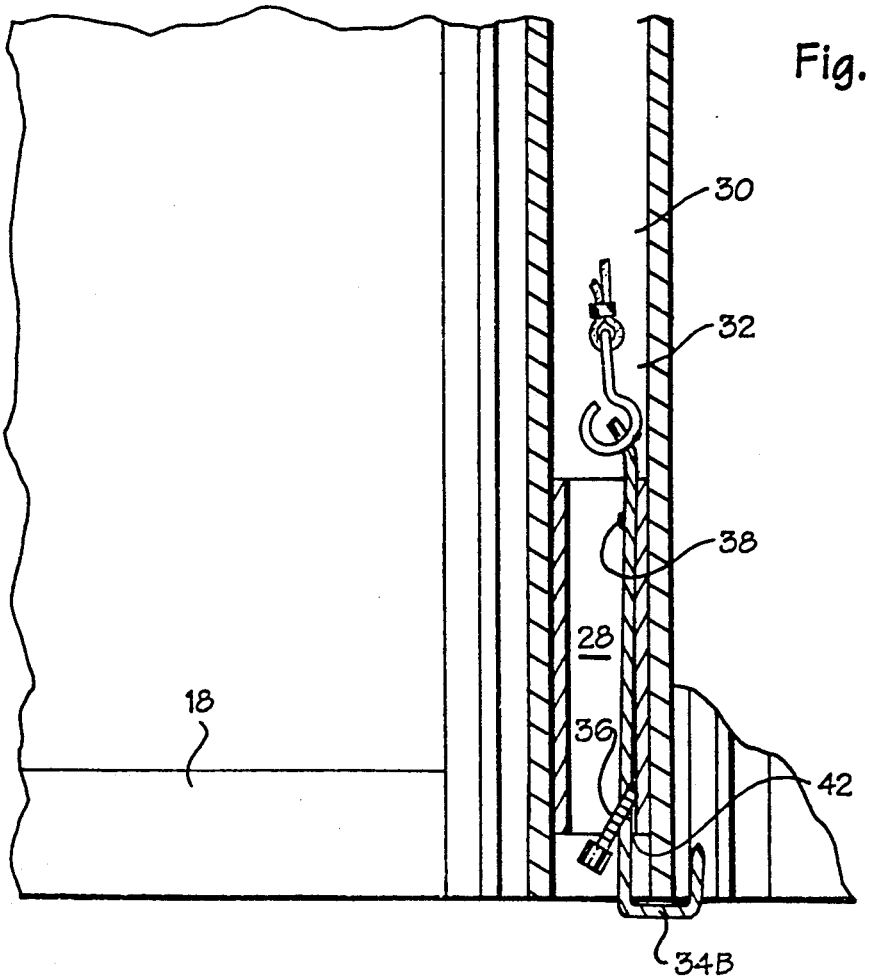

The engaging of two or more display panel assemblies via their side frame members 16 is best seen in FIGS. 2 and 3. Preferably, for each panel 12, 14, two side frame members 16 and two frame members 18 are employed. The side frame members 16 are arranged along the vertical edges of the respective panel and the upper and lower frame members 18 are arranged along the horizontal edges thereof. Each side frame member 16 has an inwardly opening channel 22 designed to receive one side edge of the individual respective panel 12, 14. Each side frame member 16 also is formed with a cavity 24 which may be of a circular cross-section extending the length of the side frame member 16 and separated from the channel 22 by a wall 26.

In this embodiment, the channel 22 is defined by opposed walls 23A and 23B, each fixed at its inner end to the wall 26 separating the channel 22 and cavity 24. Flanges 25A and 25B extend inwardly toward each other from the opposed walls 23A and 23B, terminating in spaced relation to one another. In this preferred embodiment, the cavity 24 is defined by a cylindrical wall 27 extending outwardly from and merging inwardly with the wall 26 separating the cavity 24 and the channel 22. Preferably, each side frame member 16 is formed as an integral structure.

Figure 4:
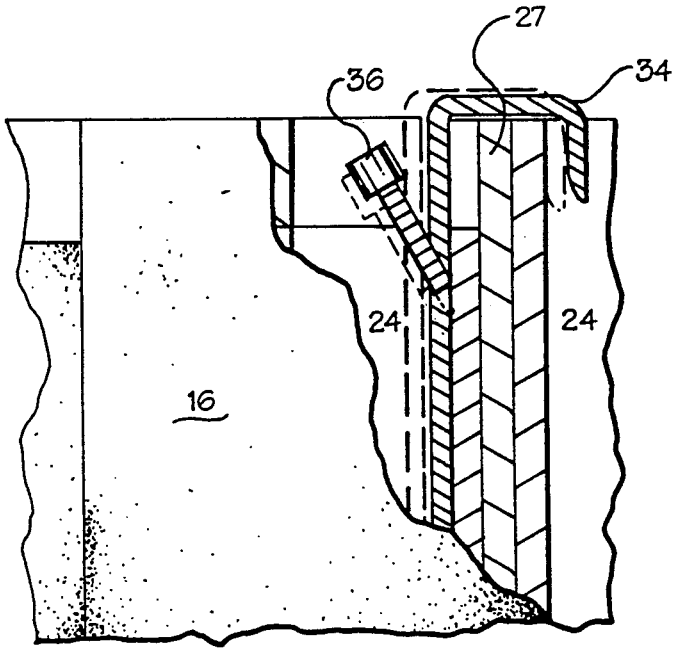
FIG. 4 is a detailed view of one end of the panel side frame member of FIG. 3 having the assembly device therein in its extended position connecting a second panel frame member.

The assembly device 20 referred to in FIG. 1 is shown in more detail in FIGS. 2, 3 and 4. The assembly device 20 is located within the cavity 24 of each side frame member 16 for quick connection and disconnection of the plurality of individual display panel assemblies. Thus, the assembly device 20 should be shaped to be received within cavity 24. The assembly device 20 has first and second body portions 28 which are preferably cylindrical and connected within the cavity 24 via an extensible member 30. The extensible member may be a spring or preferably an elastic rope such as a bungee-type cord.

Figure 6:
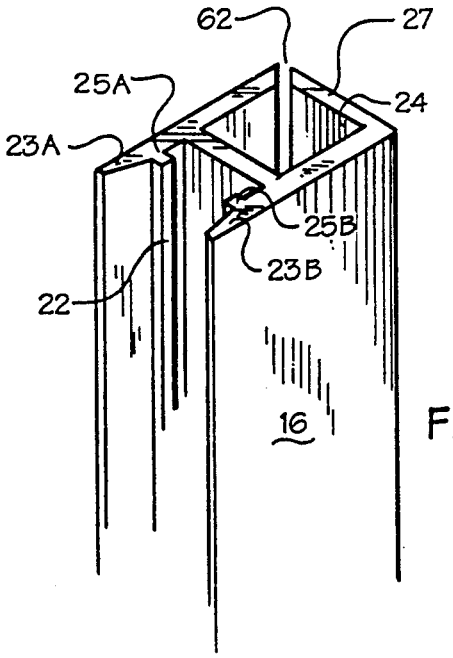
FIG. 6 is a perspective view of yet another embodiment of the side frame member.

In this embodiment as shown in FIG. 3, it can be seen that the body portion 28 is a hollow cylindrical member. Alternatively, body portion 28 may be a partially solid cylindrical member. The cavity is preferably cylindrical but may be square or rectangular as shown in FIG. 6 and discussed hereinafter. However, a cylindrical shape for the body portion 28 would still be preferred even with such a cavity. For example, if the cavity 24 is square, the cross section of the body portion 28 would be a cylinder having a diameter less than the dimension of square's sides to allow the body portion to fit within the cavity and rotate.

A connection member 34 is also included in the assembly device 20 and is preferably in the form of a leaf spring, spot welded at 38 to the body portion 28 and has a hook-shaped upper end and an exposed lower end connected to an eyelet 32 through which the extensible member is knotted or otherwise affixed as shown in FIG. 2. Alternatively, the extensible member 30 may be attached directly to the lower end of the leaf spring connector 34 or directly to the body portion 28. Notably, the extensible member 30 may be stretched to allow the body portions 28 and connection members 34 to be pulled beyond the opposite ends of cavity 24.

The abutting side frame members 16 and therefore the individual display panels 12, 14 are secured to one another via their connection devices 34 attached to the body portion 28 of the respective assembly devices 20. Preferably, connection member 34 has a hook-shaped upper end as shown in FIG. 2. The hook 34 should be blunt to avoid any injury to the person assembling the display. The connection member 34, being secured to the body portion 28, is movable therewith between an inoperative position of the connection member shown at 34A housed within the cavity 24 and an engaged position shown at 34B. In its inoperative position 34A, the hooked end of the connection member 34 rests on wall 26 as shown in FIG. 2. However, when in its engaged position 34B, the hooked end of the connection member engages the outer wall 27 of the cavity 24 of both its own respective side frame member 16 and another display panel's side frame member 16. Additionally, each assembly device 20 can include a securing means 36, which is preferably a screw threadedly extending through the connection member 34 into engagement with the interior surface of the side frame members 16 or body portion 28 within its cavity 24, as best shown in FIG. 4. The screw 36 may be tightened when the hook 34 is in its engaged position 34B to rigidify the assembled panel assemblies and thereby add increased stability to the overall display assembly.

In FIG. 3, two side frame members 16 of each of two panels 12 are shown connected to one another via connection members 34. The connection members are shown in their engaged position 34B wherein the connection member from one side frame member 16 is extended over the outer wall 27 thereof and over the corresponding outer wall 27 of the side frame member of the engaged panel assembly shown in dotted lines in FIG. 3. Typically, in order to connect two display panel assemblies both the upper and lower ones of connection members 34 are placed in their engaged position as seen in FIG. 3.

The securing screw 36 is shown in its retracted or open position in full lines in FIG. 4, while its tightened position is shown in broken lines. In the open position, the securing screw 36 allows the length of the connection member 34 to abut the inner wall of the body portion 28, permitting a degree of relative movability between the adjoining panel assemblies. Thus, if the securing screws 36 are not tightened, the panels 12, 14 may be engaged with each other in the desired manner with the connection member 34 prior to use and folded for travel and storage, thus allowing for quicker assembly at the display site.

Figure 5:
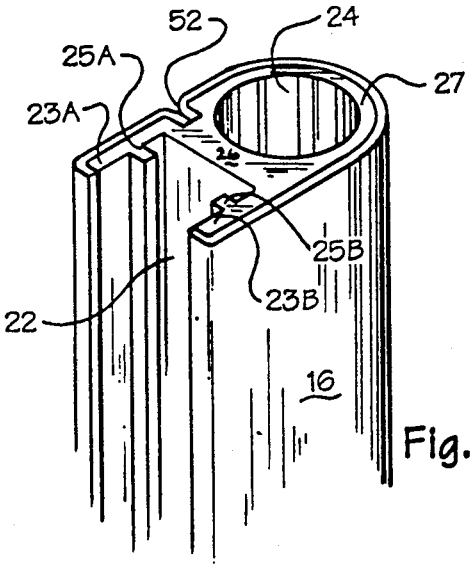
FIG. 5 is a perspective view of another embodiment of the side frame member.

Two alternate embodiments of the side frame member 16 are shown in FIGS. 5 and 6. First, in FIG. 5, the side frame member 16 of FIGS. 1–4 is provided with a lengthwise indentation 52 in the wall 26 separating the cavity 24 from the outwardly opening channel 22. This indentation can be used to hide the edge or edges of any decorative material, e.g. fabric, to be affixed as a covering material over the exposed surfaces of the side frame member 16. Alternatively, in FIG. 6, a side frame member 16 defining a square or rectangular cavity 24 is shown. Here, a gap 62 is shown running the length of the side frame members 16 at one corner thereof which may also be used to secure the edges of a covering fabric. In this manner, the side frame members 16 may be conveniently covered with the same fabric or other sheet material utilized to cover the panels 12, 14, to enhance the decorative appeal of the display assembly. In each embodiment, the location of the indentation or gap allows the side frame members to be covered partially in one covering material and partially in another covering material to conform to differing covering materials utilized on the panels.

In summary, a device for detachably connecting display panels by the use of an assembly device housed in the cavity of an upright longitudinal side frame of a display panel by means of an extensible member extending through the cavity connecting upper and lower body portions is disclosed. The body portions contain connection members, each of which can be selectively pulled outwardly from the end of its associated cavity and turned outwardly to engage with the corresponding cavity of an adjacent side frame member or, alternatively, turned inwardly to engage a wall of the side frame member if not needed for connection purposes.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In a display framing apparatus for repeated temporary uses having a plurality of individual panels, each panel having a bordering frame with at least one side frame member, the at least one side frame member having at least one end and comprising:

means at said one end of said side frame member for defining a cavity;

assembly means located within said cavity for quick connection and disconnection of said side frame member to the frame of another panel, said assembly means having connection means selectively engageable with and disengageable from the frame of another panel, said assembly means being selectively movable between an engaged position wherein said connection means is exposed from said cavity for engagement with the frame of another individual panel and an inoperative storage position wherein said connection means is disposed substantially unexposed from said cavity to avoid interference of said connection means with other of said panels; and an extensible member securing said connection means within said cavity for selective movement of said connection means by elongation of said extensible member between said inoperative position and said engaged position.

2. In a display framing apparatus of claim 1 wherein said assembly means further comprises a body portion sized to fit within said cavity and to which said connection means is secured.

3. In the display framing apparatus according to claim 1, wherein said assembly means further comprises means for adjusting said connection means to secure said side frame member with respect to the frame of another panel.

4. In the display framing apparatus according to claim 3 wherein said means for adjusting comprises a screw extending through said connection means for selectively varying its relative disposition to said side frame member.

5. In the display framing apparatus according to claim 2, wherein said body portion is cylindrical in structure and said cavity is circular in cross section.

6. In the display framing apparatus according to claim 1, wherein said connection means comprises a hook for engagement within the cavity of the side frame member of another panel.

7. In the display framing apparatus according to claim 1, wherein said extensible member is an elastic-type rope.

8. In the display framing apparatus according to claim 1, wherein said extensible member is a spring.

9. In the display framing apparatus according to claim 1, wherein said side frame member includes a cover of sheet-like material.

10. In the display framing apparatus according to claim 9 wherein said side frame member includes a longitudinal indentation for receiving an edge of said material.

11. A display framing apparatus according to claim 1 and characterized further in that said side frame member includes a wall portion inwardly bordering said cavity for engagement with said connection means in said inoperative position.

12. In a display framing apparatus for repeated temporary uses having a plurality of individual panels, each panel having a bordering frame with at least one side frame member, the at least one side frame member having opposite ends and comprising:

means for defining a cavity which extends the length of said side frame member between said opposite ends thereof;

assembly means located within said cavity for quick connection and disconnection of said side frame member to the frame of another panel, said assembly means having first and second body portions disposed respectively within said opposite ends of said cavity, each said body portion having connection means secured thereto for movement therewith between an inoperative storage position wherein said connection means is disposed substantially unexposed from said cavity to avoid interference of said connection means with other of said panels and an engaged position wherein said connection means is exposed from said cavity for engagement with the frame of another individual panel; and an extensible member securing said connection means within said cavity for selective movement of said connection means by elongation of said extensible member between said inoperative position and said engaged position.

13. In the display framing apparatus according to claim 12, wherein said assembly means further comprises means for adjusting said connection means to secure said side frame member to the frame of another panel.

14. In the display framing apparatus according to claim 13 wherein said means for adjusting comprises a screw extending through said connection means for selectively varying its relative disposition to said side frame member.

15. In the display framing apparatus according to claim 12, wherein said body portion is cylindrical in structure and said cavity is circular in cross section.

16. In the display framing apparatus according to claim 12, wherein said connection means comprises a hook for engagement within the cavity of the side frame member of another panel.

17. In the display framing apparatus according to claim 12, wherein said extensible member is an elastic-type rope.

18. In the display framing apparatus according to claim 12, wherein said extensible member is a spring.

19. In the display framing apparatus according to claim 12, wherein said side frame member includes a cover of sheet-like material.

20. In the display framing apparatus according to claim 19, wherein said side frame member includes a longitudinal indentation for receiving an edge of said cover material.

21. In a display framing apparatus for repeated temporary uses having a plurality of individual panels, each panel having a bordering frame with at least one side frame member, the at least one side frame member having opposite ends and comprising:

means for defining a cavity which extends the length of said side frame member between said opposite ends thereof;

assembly means located within said cavity for quick connection and disconnection of said side frame member to the frame of another panel, said assembly means having first and second cylindrical body portions, each said body portion having a hook secured thereto, said body portions being disposed respectively within said opposite ends of said cavity, said assembly means being selectively movable between an engaged position wherein said hook is exposed from said cavity for engagement with the frame of another individual panel and an inoperative storage position wherein said hook is disposed substantially unexposed from said cavity to avoid interference of said hook with other of said panels;

an elastic rope securing said body portions within said cavity for selective movement of each said hook by elongation of said rope between said inoperative position and said engaged position; and means for adjusting each said hook to secure said side frame member with respect to the frame of another panel, said adjusting means comprising a screw extending through each said hook for selectively varying its relative disposition to said side frame member.

* * * * *